US005785187A

United States Patent [19]

Lipman et al.

[11] Patent Number: 5,785,187

[45] Date of Patent: Jul. 28, 1998

[54] MECHANDISING DISPLAY ASSEMBLY

[76] Inventors: Daniel Lipman; Melissa E. Lipman, both of 33 Red Spring La., Glen Cove, N.Y. 11542

[21] Appl. No.: 638,816

[22] Filed: Apr. 29, 1996

[51] Int. Cl.[6] ..... A47F 5/00

[52] U.S. Cl. ..... 211/59.1; 211/54.1

[58] Field of Search ..... 211/59.1, 87.01, 211/106, 70.6, 54.1, 57.1; 248/220.4, 220.3, 221.1

[56] References Cited

U.S. PATENT DOCUMENTS

| | | | |
|---|---|---|---|
| 2,618,390 | 11/1952 | Johnson | 211/59.1 X |
| 3,799,357 | 3/1974 | Govang . | |
| 3,878,939 | 4/1975 | Wilcox . | |
| 4,170,392 | 10/1979 | Spevak . | |
| 4,509,648 | 4/1985 | Govang et al. | 211/59.1 X |
| 4,723,663 | 2/1988 | Learn . | |
| 4,726,554 | 2/1988 | Sorrell | 211/59.1 X |
| 4,788,784 | 12/1988 | Templin . | |
| 4,815,612 | 3/1989 | Leo, Sr. | 211/59.1 X |
| 4,819,800 | 4/1989 | Wilson . | |
| 4,951,827 | 8/1990 | Moransais | 211/59.1 |
| 5,050,733 | 9/1991 | Brennan . | |
| 5,303,830 | 4/1994 | Metcalf | 211/59.1 X |
| 5,595,309 | 1/1997 | Bauer et al. | 211/59.1 |

*Primary Examiner*—Alvin C. Chin-Shue
*Assistant Examiner*—Sarah Purol
*Attorney, Agent, or Firm*—Collard & Roe, P. C.

[57] ABSTRACT

A merchandising display assembly, including a substantially rigid, planar mounting board having a large number of spaced-apart bores formed therein in a predetermined pattern of parallel rows and columns. An axially-extending support rod is selectively received within a bore and frictionally retained by the bore sidewall. Display hooks extending outwardly from the support rods support and display merchandise adjacent the planar mounting board. A flexible display panel is mounted to the front surface of the mounting board. The display panel includes merchandise-identifying indicia defining a predetermined merchandise display configuration.

16 Claims, 2 Drawing Sheets

MECHANDISING DISPLAY ASSEMBLY

BACKGROUND OF THE INVENTION

1. Field of the Invention

The invention relates to a merchandising display assembly. More particularly, it relates to a mounting board which can provide a much higher density of displayed items than possible with conventional Pegboards™.

2. The Prior Art

Numerous display systems employing Pegboard, which is a registered trademark of Masonite, have been developed for hanging and displaying large varieties of goods. The prior art display systems have incorporated conventional Pegboard, that is a planar board which is usually composed of ⅛" or thicker hardboard which has been drilled to provide spaced horizontal and vertical rows of openings, generally positioned at 1" intervals. Cooperative bent wire hooks have been designed for removable connection to the Pegboard. The L-shaped end portions of the wire hooks are inserted through the Pegboard openings and pivoted down for support against a rear surface of the Pegboard.. Each hook occupies at least two holes on the Pegboard, which wastes space if the displayed item is narrower than the distance between adjacent holes.

Therefore, it would be desirable to provide a display system with narrow profile hooks to obtain higher density and more varied displays.

SUMMARY OF THE INVENTION

It is therefore an object of the present invention to provide a merchandising display assembly capable of providing higher density and therefore more varied displays.

It is a further object of the present invention to provide a planar mounting board which frictionally retains an axially-extending support rod.

These and other related objects are achieved according to the invention by a merchandising display assembly including display hooks with axially-extending support rods designed to support and display articles of merchandise comprising a substantially rigid, planar mounting board having a front surface with a multiplicity of spaced-apart bores formed, therein in a predetermined pattern. Each bore has a preset depth and is bordered by a sidewall. Each bore is adapted to selectively receive an axially-extending support rod with the sidewall frictionally retaining the support rod so that the display hooks support and display merchandise adjacent the planar mounting board. The predetermined bore pattern comprises parallel rows and columns with substantially uniform spacing between the bores of the rows and of the columns. The uniform spacing comprises approximately one-half (½) inch spacing on center between bores of the rows and of the columns. Each bore includes a bottom surface with a cylindrical portion adjacent the bottom surface and a frusto-conical portion between the cylindrical portion and the front surface. The depth of each bore is at least three times the diameter of each bore. The frusto-conical portion is bordered by a bevelled edge which forms an angle of approximately 45° with respect to the front surface of the planar mounting board.

Also according to the invention, there is provided a flexible display panel with a plurality of apertures therethrough for alignment with a cooperating plurality of bores of the mounting board. Securing means are present for removably mounting the display panel to the front surface of the mounting board with the apertures and bores thereof aligned. The display panel includes merchandise-identifying indicia on a front surface thereof cooperatively located with respect to certain of the apertures. Merchandise identified by the indicia is adapted to be supported by display hooks disposed within the apertures and frictionally retained by the cooperating bore.

The securing means comprises a frame surrounding the mounting board including a plurality of spaced slots adjacent the front surface. The securing means further comprises a plurality of outwardly-extending tabs on the display panel for engaging the slots. There is an elongate header panel secured to the mounting board with the display panel sandwiched between the header panel and the mounting board. The header panel includes a recessed front surface adapted to receive a placard containing information relating to the displayed merchandise.

A first display hook includes an axially-extending support rod and an axially-extending merchandise display portion co-linear with the support rod. The merchandising display assembly further comprises display hook means which includes a pair of parallel axially-extending support rods spaced to engage a pair of adjacent bores on the mounting board. A pair of axially-extending merchandise display portions correspond to the pair of support rods, wherein each display portion is offset from the corresponding support rod. The pair of support rods and the pair of display portions reside within a common plane.

The merchandising display assembly comprises a loop portion connecting the pair of display portions together at an end thereof remote from the support rods. The pair of display portions are offset toward each other. Alternatively, the pair of display portions are offset away from each other.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
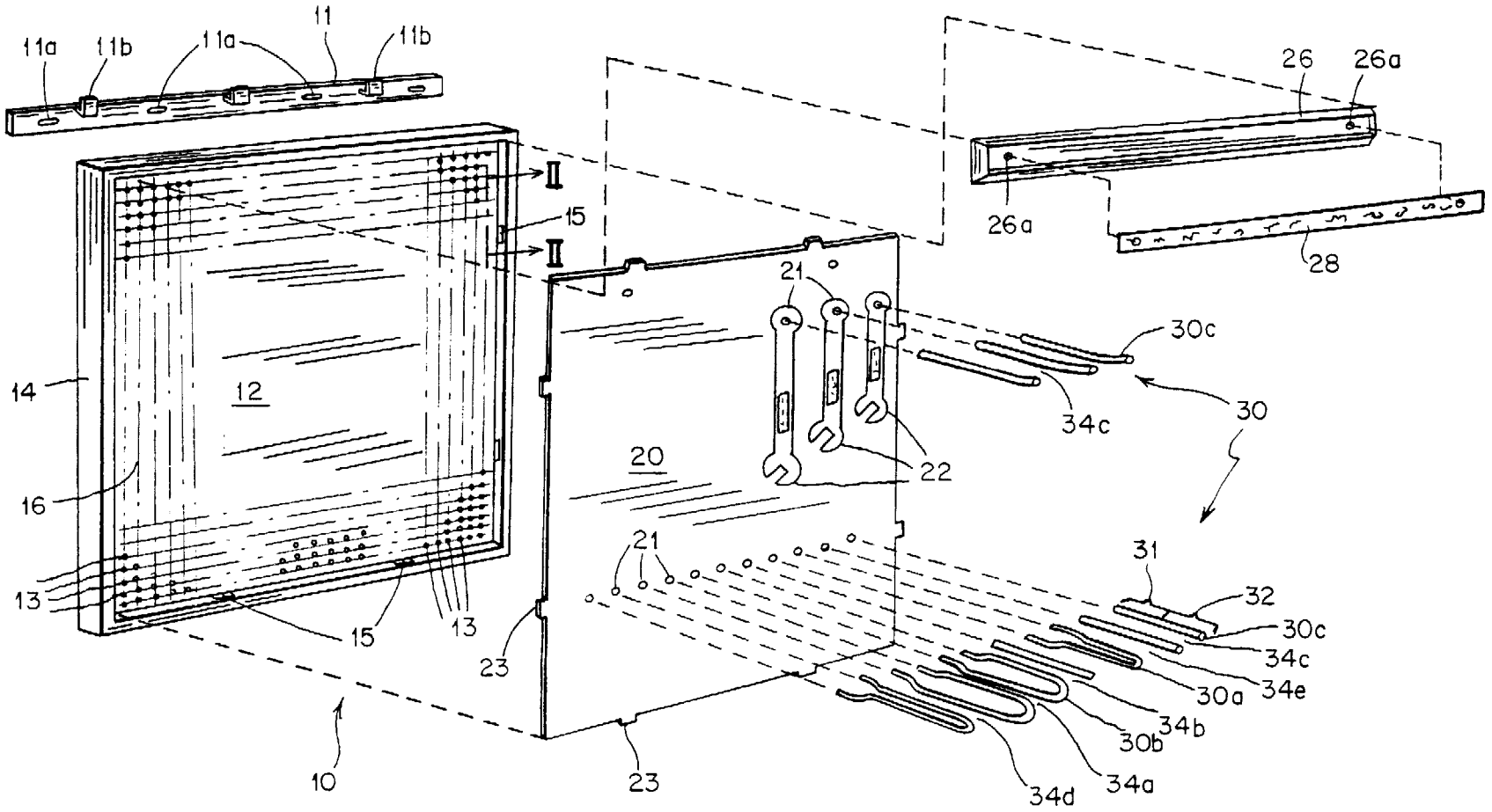
FIG. 1 is an exploded view of a merchandising display assembly according to the invention.
Figure 2:
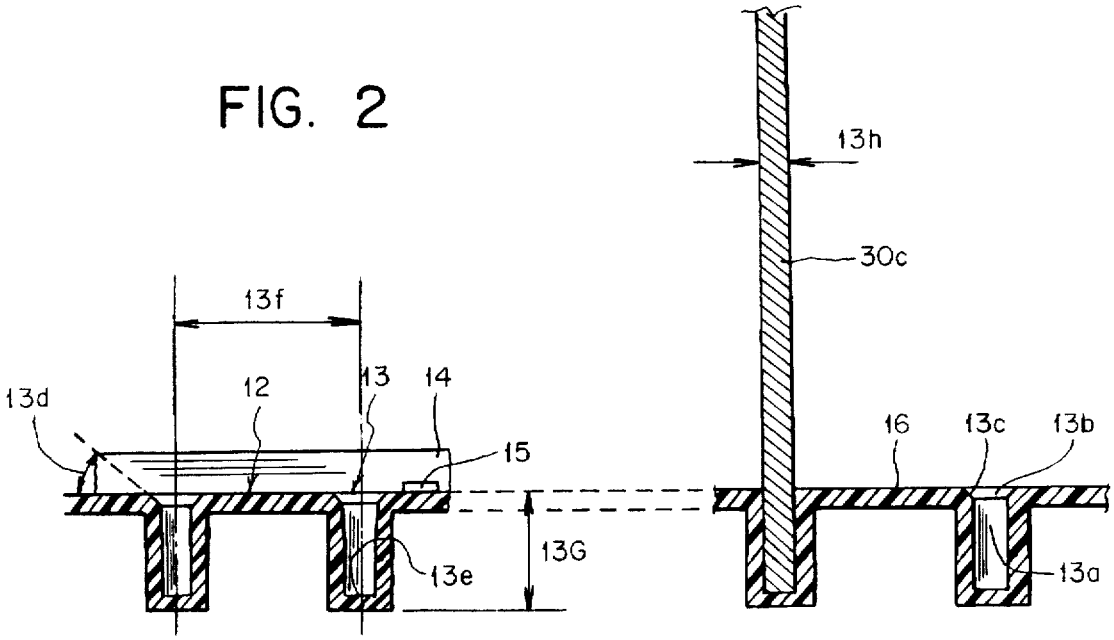
FIG. 2 is a cross-sectional view of the mounting board taken along the line II—II from FIG. 1.
Figures 3A, 3B, 3C:
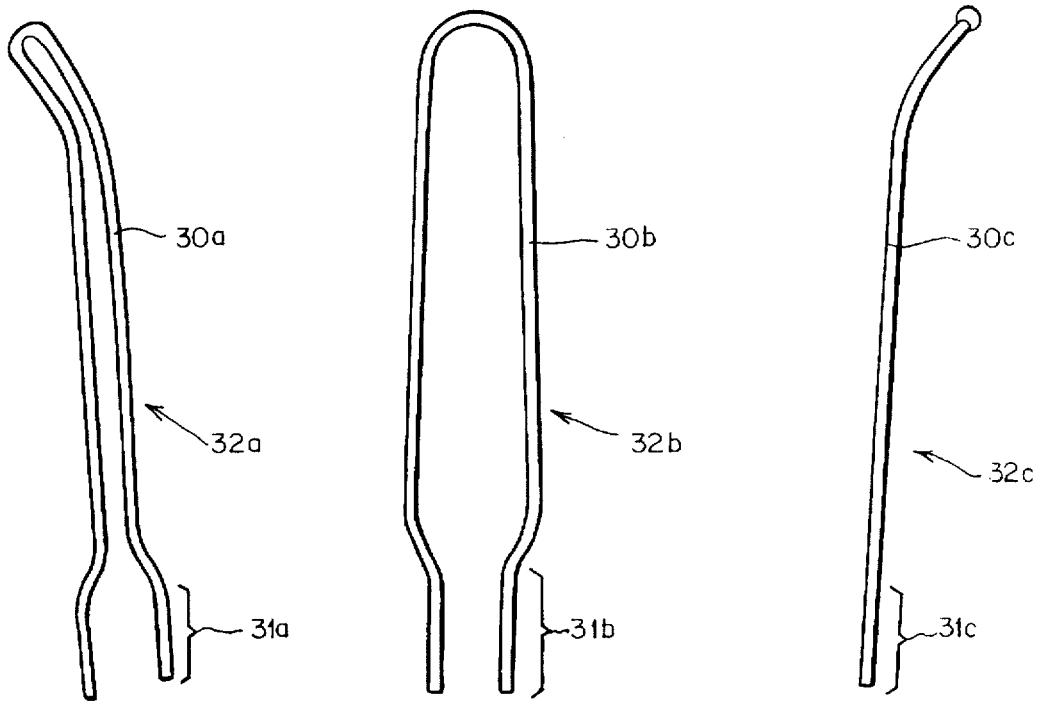
FIG. 3A is a left side elevational view of a narrow double hook according to the invention.
FIG. 3B is a top plan view of a wide double hook according to the invention.
FIG. 3C is a right side elevational view of a single hook according to the invention.

Referring now in detail to the drawings and, in particular, FIG. 1 there is shown a merchandising display assembly 10 having as its constituent components a mounting board 12, a display panel 20 and a series of variously-configured display hooks 30. Mounting board 12 is hung vertically adjacent a wall similar to a picture or Pegboard. A wall bracket 11 is secured to the wall or existing Pegboard with appropriately-sized screws or other such fastener that pass through screw holes 11*a*. L-shaped hooks 11*b* engage correspondingly-shaped apertures along the upper-rear edge of mounting board 12. Once installed, mounting board 12 provides a vertically-oriented planar surface 16 having a multiplicity of bores 13 distributed across its face. Bores 13 are regularly spaced in columns and rows, for example at a spacing of one-half (½) inch on center. Of course, alternate spacing may be provided to adjust the density of the intended display. Mounting board 12 is manufactured from any suitable rigid material, for example, plastic formed by injection molding. As can be seen in FIG. 2, the thickness of the board is approximately uniform across the planar surface 16 and underneath the bores, as required for injection molding.

A particular display arrangement is provided on display panel 20, for example by silk screening on a flexible plastic or mylar sheet. The display arrangement includes several apertures 21, which will align with corresponding bores upon installing display panel 20 onto mounting board 12. This is achieved by tabs 23 which engage apertures 15, located within frame 14, adjacent planar surface 16. Display panel 20 is folded slightly to fit within frame 14. As display panel 20 is spread out flat against planar surface 16, tabs 23 are aligned with apertures 15. Display panel 20 is stiff enough to remain in place once tabs 23 engage apertures 15. When display 20 is completely mounted, apertures 21 will be in registration with certain bores 13 on mounting board 12.

Once display panel 20 is mounted, various display hooks 30 are pushed into the apertures where they are received and frictionally retained by bores 13 of mounting board 12. Since various types of display hooks are available, display panel 20 is provided with pictorial or written indicia 22, which may provide some or all of the following information: a pictorial representation of merchandise to be displayed adjacent a particular aperture 21; a code identifying which of the various display hooks 30 should be placed into the respective aperture 21; and descriptive information identifying the particular merchandise to be displayed at that particular location. A universal display panel is also comtemplated which has a blank surface provided only with small marks indicating the location of bores 13 on the board below. Individual stores can then punch holes through the universal display panel where needed to create a customized display.

The layout of display panel 20 is critical, as the merchandising display assembly 10 is a point-of-purchase display carrying a large number of products. Because display panel 20 is easily removable, complex layouts may be developed off-site and shipped to any number of stores with the necessary hooks and new lines of merchandise. Once display panel 20 is installed onto planar surface 16, a header 26 is placed along the top portion of frame 14. Screws pass through screw holes **26*a* into a corresponding pair of bores 13. Once header 26 is secured to mounting board 12, a placard 28 is placed within the flat, front recessed portion thereof. Placard 28** may contain advertising or information relating to the products displayed below.

Referring now to FIG. 2, a single hook **30*c* is shown installed in a depression 13 of mounting board 12. Each depression 13 consists of a lower cylindrical portion 13*a* adjacent a frusto-conical portion 13*b* which is bordered by a beveled edge 13*c*. Beveled edge 13*c* forms an angle 13*d*, for example 45°, with planar surface 16. When installing either of the display hooks 30, beveled edge 13*c* allows for slight misalignment between depression 13 and apertures 21 by helping to direct support rod portion 31 into cylindrical portion 13*a* until it contacts rear wall 13*e*. Cylindrical portion 13*a* is slightly larger than support rod portion 31 such that rod portion 31 is frictionally retained in place. The material characteristics of the plastic mounting board 12 provide a slight resiliency to fully receive the metal rods within the bores despite minor inconsistencies in the configuration of the bores. Cylindrical portion 13*a* has a depth 13*g*, which is at least three times larger than its diameter or diameter 13*h* of rod portion 31. In a practical embodiment of the invention, rod portion 31 has a diameter of one-eighth of an inch with cylindrical portion 13*e* having a depth of about one-half of an inch, i.e. a depth to diameter ratio of 4 to 1. The spacing 13*f* between bores 13** is also about one-half of an inch on center.

Surprisingly, it was discovered that with such an arrangement, a single hook **30*c* could be used to effectively support merchandise. This was unexpected since Pegboards for many years always required two or more bent wire hooks disposed in two or more holes to support a single hook. Furthermore, Pegboard is very thin, with a typical thickness of about one-quarter to five-sixteenths of an inch. The Pegboard holes are designed larger than the bent wire holes to provide freedom to pivot during installation. This pivoting, however, deteriorates the Pegboard holes over time so that the hooks are only loosely connected. In contrast, the high-strength plastic of mounting board 12 is subject only to axial displacement of rod portion 31. As a result, bores 13 maintain their structural integrity indefinitely to frictionally retain rod portions 31** even when subject to repeated use.

Referring now to FIGS. 1, **3*a*, 3*b*, and 3*c* different combinations of display hooks 30 are shown. With the one-half (½) inch on center spacing of bores 13, a space 34*c* between single hooks 30*c* is slightly less than one-half (½) inch. The wide double hooks 30*b* permit a very narrow space 34*a* to be provided between pairs of wide double hooks 30*b*, and an intermediate narrow space 34*b* to be formed between a wide double hook 30*b* and a single hook 30*c*. Combinations including the narrow double hook 30*a* permit an intermediate large space 34*d* and a further large space 34*e*. A total of six different spacings can be achieved with the use of two hooks located adjacent one another. By selecting the minimum space required, the maximum display density can be achieved. It is estimated that the display density, i.e. number of items displayed per unit area of the invention may be up to 100% more than conventional displays. Each hook includes a support rod portion 31, which passes through display panel 20, to be retained in depression 13. Each hook further has a merchandise display portion 32 onto which various merchandise is supported adjacent display panel 20**.

Display panel 20 shows indicia 22 in the form of an outline of a wrench, for example. The closed box end of the wrench, or any carded merchandise, can hang from a single point. Hooks **30*c* are shown which occupy only a single depression. Therefore, a series of hooks 30*c*** can be placed in adjacent bores to support merchandise at one-half inch intervals. All prior art Pegboard hooks require two adjacent holes permitting merchandise to be supported at one-inch intervals only. Therefore, certain merchandise can achieve a twofold increase in density over prior art display systems.

Accordingly, while only several embodiments of the present invention have been shown and described, it is obvious that many changes and modifications may be made thereunto without departing from the spirit and scope of the invention.

What is claimed is:

1. A merchandising display assembly for receiving display hooks with axially-extending support rods designed to support and display articles of merchandise comprising:

a substantially rigid, planar mounting board having a front surface with a multiplicity of spaced-apart bores formed therein in a predetermined pattern, each bore having a diameter and a preset depth and being bordered by a sidewall, the depth of each bore being at least three times the diameter of each bore;

wherein each bore is adapted to selectively receive an axially-extending support rod with said sidewall frictionally retaining the support rod so that the display hooks support and display merchandise adjacent the planar mounting board.

2. The merchandising display assembly according to claim 1, wherein the predetermined bore pattern comprises parallel rows and columns with substantially uniform spacing between the bores of the rows and of the columns.

3. The merchandising display assembly according to claim 2, wherein said uniform spacing comprises approximately one-half (½) inch spacing on center between the bores of the rows and of the columns.

4. The merchandising display assembly according to claim 2, wherein each bore includes a cylindrical portion spaced from said front surface and a frusto-conical portion between said cylindrical portion and said front surface.

5. The merchandising display assembly according claim 4, wherein said frusto-conical portion is bordered by a bevelled edge which forms an angle of approximately 45° with respect to said front surface of said planar mounting board.

6. The merchandising display assembly according to claim 1, comprising:

a flexible display panel having a plurality of apertures therethrough for alignment with a cooperating plurality of bores of said mounting board; and securing means for removably mounting said display panel to said front surface of said mounting board with said apertures and bores thereof aligned.

7. The merchandising display assembly according to claim 6, wherein said display panel includes merchandise-identifying indicia on a front surface thereof cooperatively located with respect to certain of said apertures, whereby merchandise identified by said indicia is adapted to be supported by display hooks located within the certain apertures and frictionally retained by the cooperating bore.

8. The merchandising display assembly according to claim 6, wherein said securing means comprises:

a frame surrounding said mounting board including a plurality of spaced slots adjacent said front surface; and a plurality of outwardly-extending tabs on said display panel for engaging said slots.

9. The merchandising display assembly according to claim 8, comprising an elongate header panel secured to said mounting board with said display panel sandwiched between said header panel and said mounting board.

10. The merchandising display assembly according to claim 9, wherein said header panel includes a recessed front surface adapted to receive a placard containing information relating to the displayed merchandise.

11. The merchandising display assembly according to claim 1, in combination with a first display hook comprising an axially-extending support rod and an axially-extending merchandise display portion co-linear with said support rod.

12. The merchandising display assembly according to claim 1, in combination with display hook means comprising;

a pair of parallel axially-extending support rods spaced to engage a pair of adjacent bores on said mounting board; and a pair of axially-extending merchandise display portions corresponding to said pair of support rods, wherein each display portion is offset from the corresponding support rod.

13. The merchandising display assembly according to claim 12, wherein said pair of support rods and said pair of display portions reside within a common plane.

14. The merchandising display assembly according to claim 13, comprising a loop portion connecting said pair of display portions together at an end thereof remote from said support rods.

15. The merchandising display assembly according to claim 14, wherein said pair of display portions are offset toward each other.

16. The merchandising display assembly according to claim 14, wherein said pair of display portions are offset away from each other.

* * * * *